US006227827B1

(12) United States Patent
Iwasa et al.

(10) Patent No.: US 6,227,827 B1
(45) Date of Patent: May 8, 2001

(54) SCROLL COMPRESSOR AND ITS SEALING METHOD

(75) Inventors: Makoto Iwasa; Nobuaki Ogawa, both of Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/342,014

(22) Filed: Jun. 28, 1999

(30) Foreign Application Priority Data

Oct. 5, 1998 (JP) ..... 10-282444

(51) Int. Cl.[7] ..... F04C 18/04; F04C 27/00
(52) U.S. Cl. ..... 418/1; 418/55.4
(58) Field of Search ..... 418/1, 55.1, 55.4

(56) References Cited

U.S. PATENT DOCUMENTS 4,411,604 * 10/1983 Terauchi ..... 418/55.1
5,569,028 10/1996 Yamamura et al. ..... 418/55.4

FOREIGN PATENT DOCUMENTS 63-158594 10/1988 (JP) .
09166095 6/1997 (JP) .

* cited by examiner

*Primary Examiner*—John J. Vrablik
(74) *Attorney, Agent, or Firm*—Ratner & Prestia

(57) ABSTRACT

A scroll compressor which can be easily sealed and assembled is presented. Also a scroll compressor which can be sealed easily and at low cost is presented. It includes a cylindrical front casing with a bottom, a rear cover to be fitted to the inner circumference of the front casing, a fixed scroll having an end plate to be fitted to the inner circumference, a fitting portion to be fitted concentrically to the rear cover, and a spiral blade disposed at the opposite side of the fitting portion, a movable scroll engaged with the fixed scroll and swiveling at a specified radius of swivel, and a rotation preventive mechanism for preventing rotation of the movable scroll and permitting swivel motion only. By assembling the fixed scroll and rear cover, a nearly triangular recess is formed in the butt junction of the end plate and rear cover, a seal member is fitted into the recess, and the fixed scroll and rear cover fitting the seal member are assembled into the front casing, thereby sealing both between the suction pressure and discharge pressure, and between the atmospheric pressure and discharge pressure.

9 Claims, 5 Drawing Sheets

SCROLL COMPRESSOR AND ITS SEALING METHOD

FIELD OF THE INVENTION

The present invention relates to a scroll compressor, and more particularly to a scroll compressor of an air conditioner used in automobile or the like.

BACKGROUND OF THE INVENTION

A conventional scroll compressor comprises, as shown in FIG. 6, a rear casing 32 having an opening at the front side, and a front cover 31 placed in its opening. A movable scroll 34, a fixed scroll 39, and a rotation preventive mechanism 36 are disposed in the rear casing,32. An outer circumference of the fixed scroll 39 contacts with an inner circumference of the rear casing 32. The movable scroll 34 is placed between the front cover 31 and the fixed scroll 39 in order to swivel while contacting with the surface of the fixed scroll 39. The rotation preventive mechanism 36 is placed between the movable scroll 34 and the front cover 31 in order to allow the swivel motion only while preventing rotation of the movable scroll 34. A suction chamber 46 for sucking a refrigerant and a discharge chamber 47 for discharging the refrigerant are mutually partitioned through the fixed scroll 39. A suction port 32*c* for sucking the refrigerant is formed in an outer wall of the rear casing 32 of the suction chamber 46. A discharge port 32*d* for discharging the refrigerant is formed in the outer wall of the rear casing 32 of the discharge chamber 47. A first seal member 41 having an O-ring 41 is placed between the inner circumference 32*a* of the rear casing 32 and the fixed scroll 39. This first seal member 41 seals between the fixed scroll 39 and the rear casing 32. It is thus completely sealed between the suction chamber 46 and discharge chamber 47. A plurality of mounting bases 32*b* for mounting on a vehicle or other mechanical structure are integrally disposed on the outer wall of the rear casing 32. The front cover 31 has a clutch mounting section 31*c*. A shaft 40 is installed so as to cooperate with the movable scroll 34, and this shaft 40 penetrates through the clutch mounting section 31*c*, and has its leading end exposed outside. An electromagnetic clutch 38 is installed outside of the clutch mounting section 31*c*, and is coupled to the shaft 10. The front cover 31 is coupled to the rear casing 32 through a second seal member 45, by using bolt 44 or other bonding member. The second seal member 45 seals between the front cover 31 and rear casing 32, and by this seal member 45, the suction chamber 46 and the outside are completely isolated.

Thus, a pressure vessel sealing mutually between the suction pressure and atmospheric pressure was constituted by using the first seal member 41 and second seal member 45.

Such conventional compressor, however, required two seal members, that is, the first seal member 41 for sealing between the suction chamber 46 and the discharge chamber 47, and the second seal member 45 for sealing between the suction chamber 46 and the outside, and the compressor assembling process was complicated, and the manufacturing cost was high.

It is an object of the invention to present a scroll compressor that is easier to assemble and is lower in manufacturing cost.

SUMMARY OF THE INVENTION

The sealing method of the scroll compressor of the invention is a sealing method of a scroll compressor which comprises:

(a) a cylindrical front casing having a bottom, an opening, and an inner circumference, (b) a rear cover fitted to the inner circumference to cover the opening, (c) a fixed scroll having an end plate fitted to the inner circumference, a fitting portion fitted concentrically to the rear cover, and a spiral blade, (d) a movable scroll engaged with the fixed scroll to swivel in a specified radius of swivel, and (e) a rotation preventive mechanism for preventing rotation of the movable scroll to permit swivel motion only.

The sealing method is characterized by forming a recess in the butt junction of the end plate and the rear cover by assembling the fixed scroll and the rear cover, fitting a seal member to the recess, and assembling the fixed scroll and rear cover fitting the seal member into the front casing, and sealing both between the suction pressure and discharge pressure, and between the discharge pressure and atmospheric pressure.

A scroll compressor for compressing refrigerant of the invention comprises:

(a) a front casing having an inner circumference, a bottom and an opening, (b) a fixed scroll disposed in the front casing, (c) a movable scroll disposed between the bottom and the fixed scroll, (d) a rear cover disposed to cover the opening, (e) a suction chamber surrounded by the inner circumference, fixed scroll, and rear cover, (f) a discharge chamber surrounded by the inner circumference, fixed scroll, and rear cover, and (g) a seal member.

The fixed scroll has a first fitting portion and a first outer circumference fitted to the inner circumference, the rear cover has a second fitting portion, and a second outer circumference fitted to the inner circumference, the first fitting portion and the second fitting portion form a mutually joined butt junction, the seal member is disposed at the butt junction so as to contact with the first fitting portion, second fitting portion and the inner circumference, and the seal member seals between the suction chamber and the discharge chamber, and between the outside of the rear cover and the discharge chamber.

Preferably, the butt junction forms a recess surrounded by the first outer circumference, second outer circumference, and inner circumference, and the seal member is disposed in the recess.

Preferably, the recess has a nearly triangular shape.

In this constitution, the pressure in the suction chamber composed of the front casing and fixed scroll, the pressure in the discharge chamber composed of the fixed scroll and rear cover, and the atmospheric pressure are partitioned by one seal member disposed in the recess, so that the scroll compressor can be easily sealed and assembled.

Moreover, by using one seal member only, the scroll compressor can be sealed, so that the manufacturing cost may be saved.

Reference Numerals

Front casing

Figure 1:
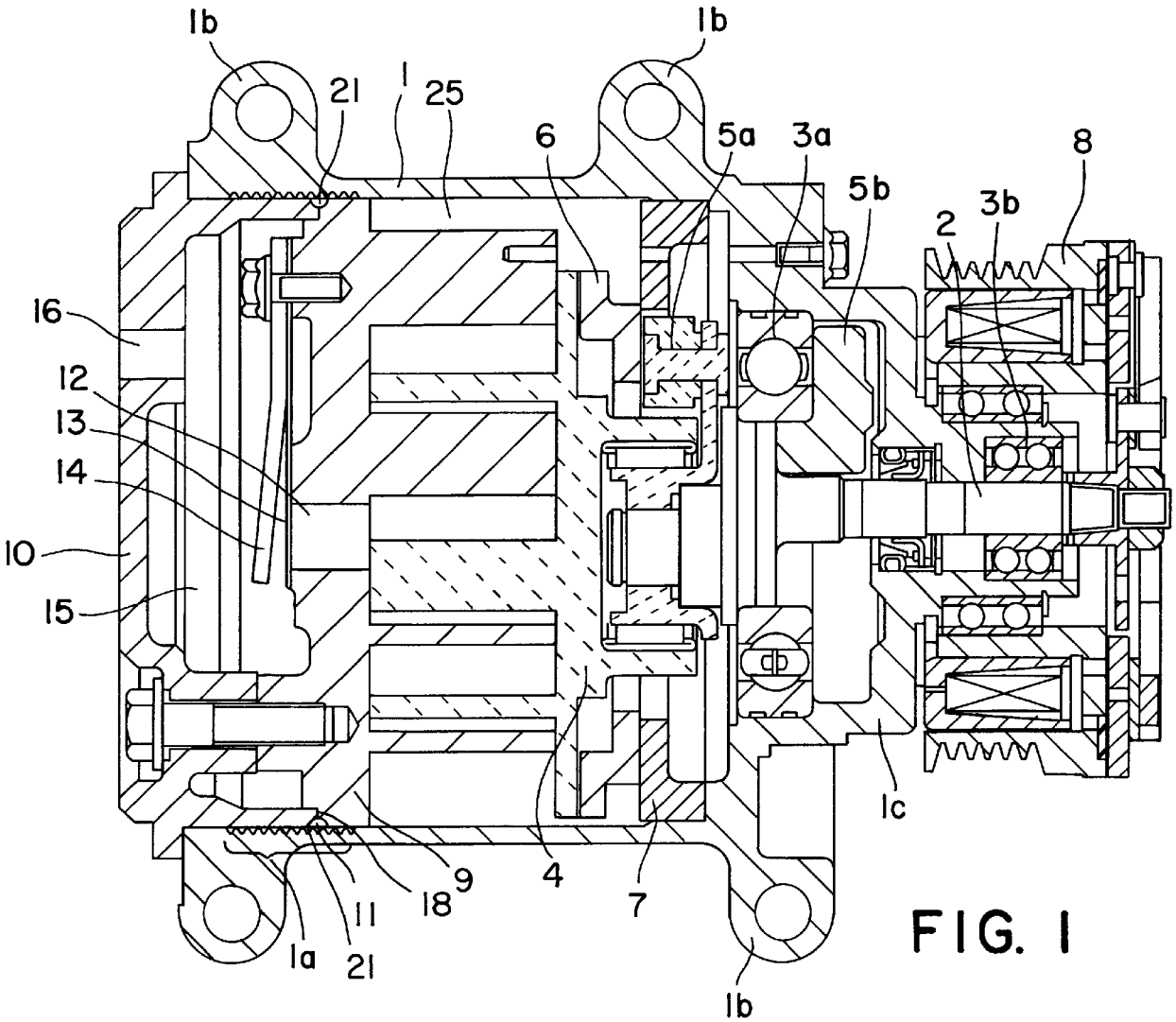
FIG. 1 is a sectional view of a scroll compressor in a first embodiment of the invention.

1*a* Inner circumference (fitting surface)
1*b* Base
1*c* Bottom
2 Crankshaft
3*a*, 3*b* Bearing
4 Movable scroll
5*a*, 5*b* Balancer
6 Oldham's ring (rotation preventive mechanism)
7 Slot plate
8 Electromagnetic clutch
9 Fixed scroll
9*a* End plate
9*b* Outer circumference
9*c* Blade
9*d* First fitting portion
9*e* First chamfering portion
9*f* Reference hole
10 Rear cover
10*a* Cylindrical portion
10*b* Cover portion
10*d* Second fitting portion
10*e* Second chamfering portion
11 O-ring (seal member)
12 Discharge hole
14 Valve retainer
15 Discharge chamber
16 Discharge port
17 Coupling hole
18 Butt junction
21 Recess
25 Suction chamber

DETAILED DESCRIPTION OF THE INVENTION

The compressor of the invention comprises a cylindrical front casing with a bottom and a rear cover fitted to the inner circumference of the front casing. The front casing incorporates an end plate, a fixed scroll, a movable scroll, and a drive mechanism. The end plate is fitted to the inner circumference of the front casing. The fixed scroll has a fitting portion to be fitted concentrically to the rear cover, and a spiral blade formed at the opposite side of this fitting portion. The movable scroll is engaged with the fixed scroll, and swivels at a specified radius of swivel. The drive mechanism includes a rotation preventive mechanism which permits only swivel motion of the movable scroll and prevents its rotation. A pressure vessel is composed by assembling the rear cover fitted and coupled to the fixed scroll into the front casing incorporating the movable scroll and drive mechanism. By assembling the fixed scroll and rear cover, one nearly triangular recess is formed at the butt junction of the end plate and rear cover. A seal member is fitted into this recess, and they are assembled into the front casing, which seals both between the suction pressure and discharge pressure, and between atmospheric pressure and discharge pressure.

In this constitution, one seal member seals the suction pressure, discharge pressure, and atmospheric pressure mutually. As a result, an easily sealed scroll compressor is obtained. The manufacturing cost. is saved. Moreover, the compressor can be installed easily at correct position at high precision.

Referring now to the drawings, an embodiment of the invention is described below.

FIG.1 is a longitudinal sectional view showing an assembled state of a scroll compressor. In FIG. 1, the scroll compressor comprises a front casing 1, a rear cover 10, a fixed scroll 9, a movable scroll 4, a rotation preventive mechanism 6, and a seal member 11. The front casing 1 has a cylindrical shape forming a bottom 1*c*. A crankshaft 2, balancers 5*a*, 5*b*, an Oldham's ring 6 as rotation preventive mechanism, and a slot plate 7 are installed in the bottom 1*c* of the front casing 1. The crankshaft 2 is supported by bearings 3*a*, 3*b*. The movable scroll 4 is driven by the crankshaft 2. The balancers 5*a*, 5*b* serve to cancel the imbalance of the movable scroll 4. The rotation preventive mechanism 6 prevents rotation of the movable scroll 4, and permits only swivel motion. The slot plate 7 holds the Oldham's ring 6.

An electromagnetic clutch 8 is fitted to the leading end of the crankshaft 2. The electromagnetic clutch 8 transmits rotation of the engine or automobile or other machine to the crankshaft 2, and turns on and of f the operation of the compressor.

The front casing 1 has an inner circumference 1*a* has the fitting surface to be fitted to the fixed scroll 9 and rear cover 10, and an O-ring 11 as the seal member is disposed to abut against the fitting surface 1*a*. The O-ring 11 as the seal member is not particularly limited, and a deformable elastic material is used as the seal member, such as synthetic rubber, natural rubber, plastic material, and inorganic material.

The front casing 1 has a base 1*b* formed at the side wall. The base 1*b* is fitted to an external device such as an automobile. That is, both the bottom 1*c* for holding the crankshaft 2 and the base 1*b* for fixing to the external device are formed in the front casing 1. Accordingly, the base 1*b* and electromagnetic clutch 8 are easily installed in the external device and coupled at correct position at high precision.

Figure 2A:
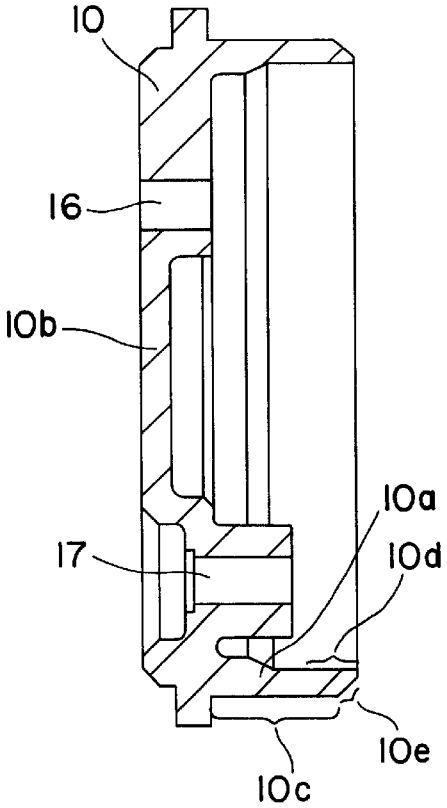
FIG. 2(*a*) is a sectional view of a rear cover alone shown in FIG. 1, and FIG. 2(*b*) is a sectional view of a fixed scroll alone.
Figure 2B:
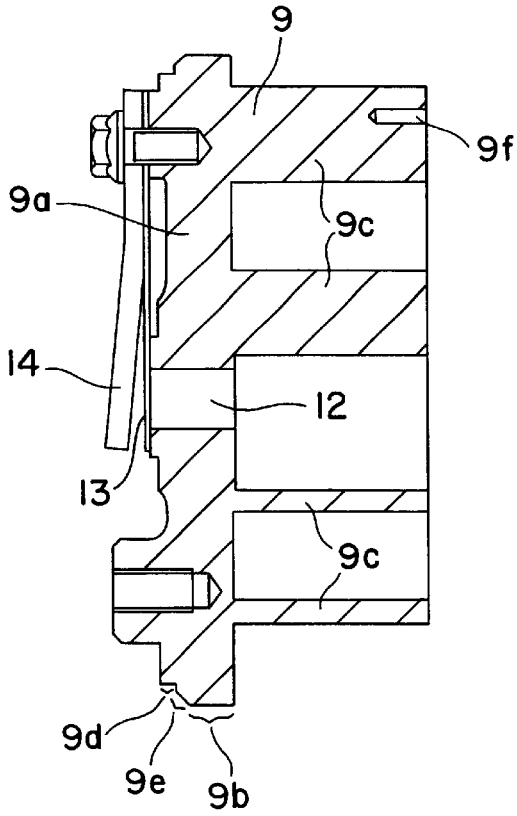

FIG. 2(*b*) is a sectional view of the fixed scroll 9 alone in the embodiment. The fixed scroll 9 has an end plate 9*a* and a spiral blade 9*c*. The end plate 9*a* is fitted to the outer circumference 9*b* of the fitting surface 1*a* of the front casing 1. The blade 9*c* is disposed upright on the end plate 9*a*. The blade 9*c* is disposed to be engaged with the movable scroll. The end plate 9*a* has a first fitting portion 9*d* and a first chamfering portion 9*e* formed at the opposite side of the blade 9*c*.

The first chamfering portion 9*e* is formed at the edge of the outer circumference 9*b* adjacently to the first fitting portion 9*d*. The first fitting portion 9*d* is fitted and coupled concentrically to the rear cover 10. An assembly reference hole 9*f* is formed at the blade 9*c* side, and this assembly reference hole 9*f* is used as the reference when assembling the fixed roll 9.

A discharge hole 12 is formed nearly in the center of the end plate 9*a*. To cover the discharge hole 12, a discharge valve 13 and a valve retainer 14 are installed. The discharge valve 13 and valve retainer 14 open or close the discharge hole 12. The front casing 1 and fixed scroll 9 form a suction chamber 25. The rear cover 10 and fixed scroll 9 form a discharge chamber 15. A suction port (not shown) is formed in the wall of the front casing 1 of the suction chamber 25. A discharge port 16 is formed in the rear cover 10 of the discharge chamber 15.

A refrigerant is sucked into the suction chamber 25 from the suction port, and the refrigerant in the suction chamber 25 is compressed by the fixed scroll and movable scroll 4. The compressed refrigerant is discharged into the discharge chamber 15 through the discharge hole 12.

FIG. 2(*a*) is a sectional view of the rear cover 10 alone of the embodiment. The rear cover 10 has a cover portion 10*b*, and a cylindrical portion 10*a* disposed upright on the cover portion 10*b*. The cover portion 10*b* has a discharge port 16, a coupling hole 17, and a fixing hole (not shown).

The refrigerant flows from the discharge chamber 15 through the discharge port 16, and is discharged into the air conditioner cycle. The coupling hole 17 couples the fixed scroll 9 to the rear cover 10. The fixing hole fixes the rear cover 10 to the front casing 1. After the fixed scroll 9 is fitted into the front casing 1, in order to seal within the front casing 1, the fixed scroll 9 is fitted by means of screw or other fixing means (not shown).

The cylindrical portion 10*a* has a second fitting portion 10*d* formed at the end, and a second chamfering portion 10*e* formed at the outer edge of the end. The second fitting portion 10*d* is fitted to the first fitting portion 9*d* of the end plate 9*a*.

The fixed scroll 9 and the rear cover 10 are concentrically coupled by screw or other means through engagement of the first fitting portion 9*d* and second fitting portion 10*d*. When the fixed scroll 9 and the rear cover 10 are mutually coupled, at the butt junction 18 of the end plate 9*a* and the end of the cylindrical portion 10*a*, the first chamfering portion 9*e* and second chamfering portion 10*e* form a nearly triangular recess. The O-ring 11 is fitted into the recess. With the O-ring 11 fitted into the recess, the fixed scroll 9 and rear cover 10 are assembled into the front casing 1. In this state, the space in the nearly triangular recess is formed by the fitting surface 1*a*, first chamfering portion 9*e*, and second chamfering portion 10*e*.

Figure 3A:
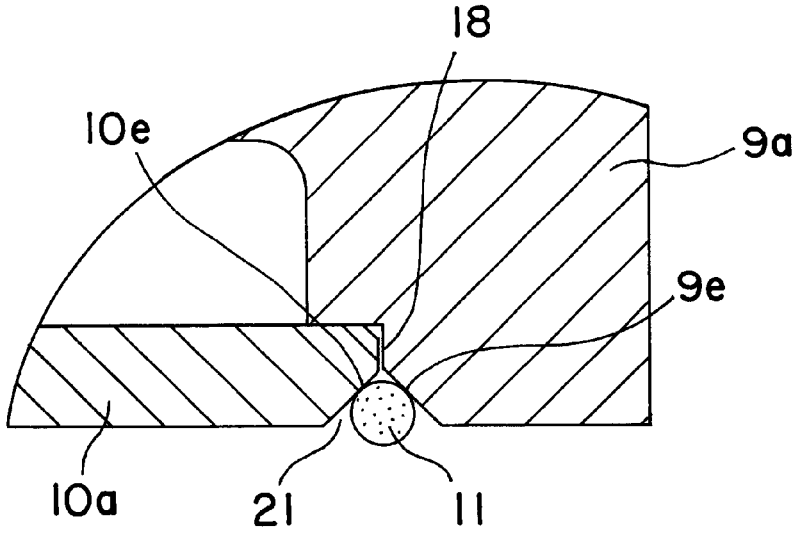
FIG. 3(*a*) and FIG. 3(*b*) are magnified sectional views showing a recess in a nearly triangular shape.
Figure 3B:
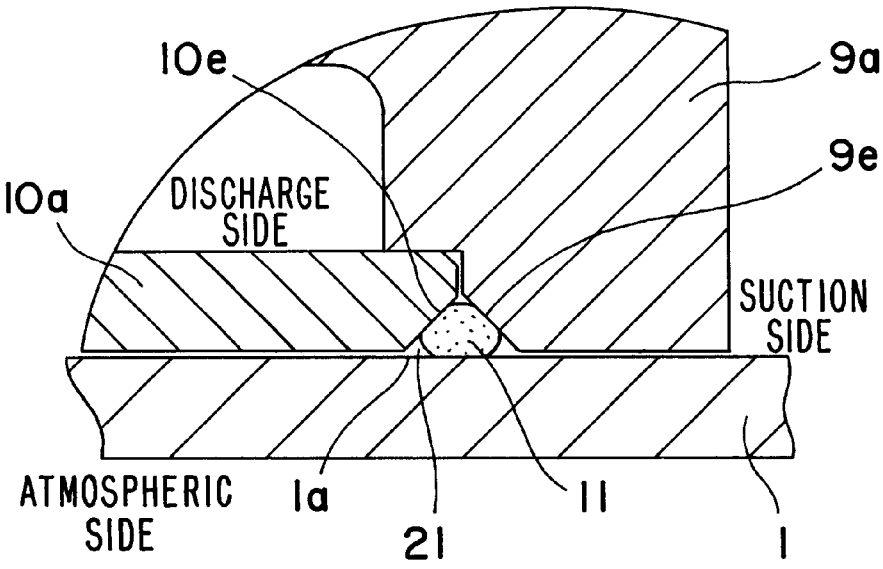
Figure 4A:
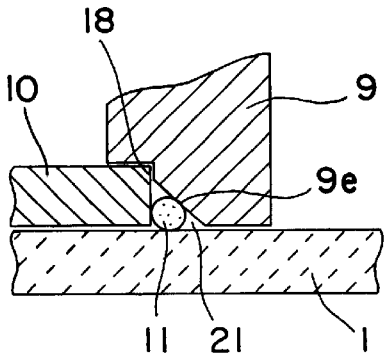
FIG. 4(*a*) to FIG. 4(*d*) are sectional views showing modified examples of the recess.
Figure 4B:
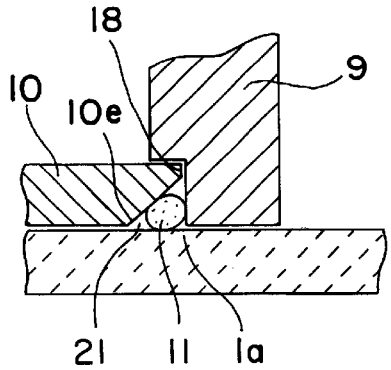
Figure 4C:
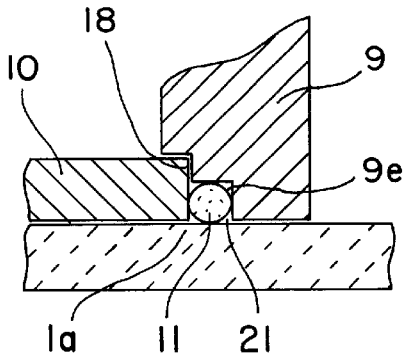
Figure 4D:
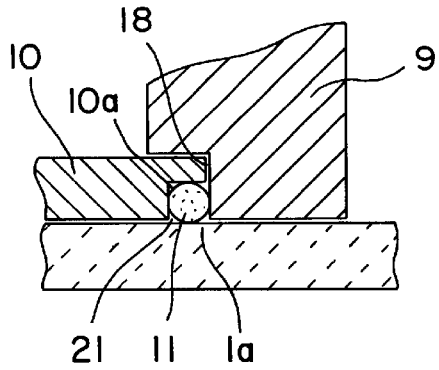

FIG. 3 is an essential magnified sectional view showing an assembled state of O-ring 11 in the recess space formed by the fitting surface. 1*a*, first chamfering portion 9*e*, and second chamfering portion 10*e*. As shown in FIG. 3(*a*), an O-ring is fitted into a recess 21 formed by the first chamfering portion 9*e* and second chamfering portion 10*e*. Next, as shown in FIG. 3(*b*), the fixed scroll 9 having the O-ring fitted into the recess 21 and the rear cover 10 are assembled into the front casing 1.

The O-ring 11 assembled in the front casing 1 abuts against the fitting surface la of the front casing 1, and also abuts against the fitting surface 1*a* with the first chamfering portion 9*e* and the second chamfering portion 10*e*. Thus, the O-ring 11 is sealed, in the recess 21, as being pressed against the fitting surface la with the first chamfering portion 9*e* and second chamfering portion 10*e*.

In this constitution, the compressor outside, suction chamber 25, and discharge chamber 15 are mutually sealed. That is, between the O-ring 11 and the fitting surface 1*a*, the suction pressure and atmospheric pressure are sealed, and between the first chamfering portion 9*e* and the O-ring 11, the suction pressure and discharge pressure are sealed, and further between the second chamfering portion 10*e* and the O-ring 11, the discharge pressure and atmospheric pressure are sealed.

In this constitution, the refrigerant enters the suction chamber 25 through the suction port formed in the suction chamber. 25, and enters the discharge chamber 15 through the discharge hole 12, and gets into the refrigeration cycle through the discharge port 16.

In this embodiment, the following modifications are also possible.

As shown in FIG. 4(*a*) or FIG. 4(*b*), only one of the fixed scroll 9 and rear cover 10 has a chamfering portion (9*e* or 10*e*) at the butt junction 18, and the recess 21 is formed as being surrounded by its chamfering portion and inner circumference 1*a*.

As shown in FIG. 4(*c*) or FIG. 4(*d*), only one of the fixed scroll 9 and rear cover 10 has a recess at the butt junction 18, and this recess is formed as being surrounded by the fixed scroll 9, rear cover 10, and inner circumference 1*a*.

The compressor thus constituted as shown in FIG. 4 has an excellent sealing characteristic. However, its effect is slightly smaller than in the above embodiment.

Figure 5:
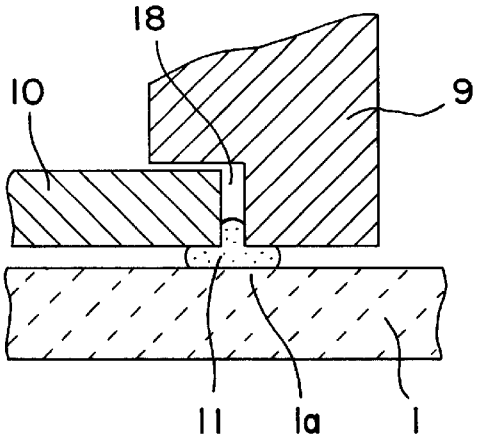
FIG. 5 is a sectional view showing a modified example of the seal member.
Figure 6:
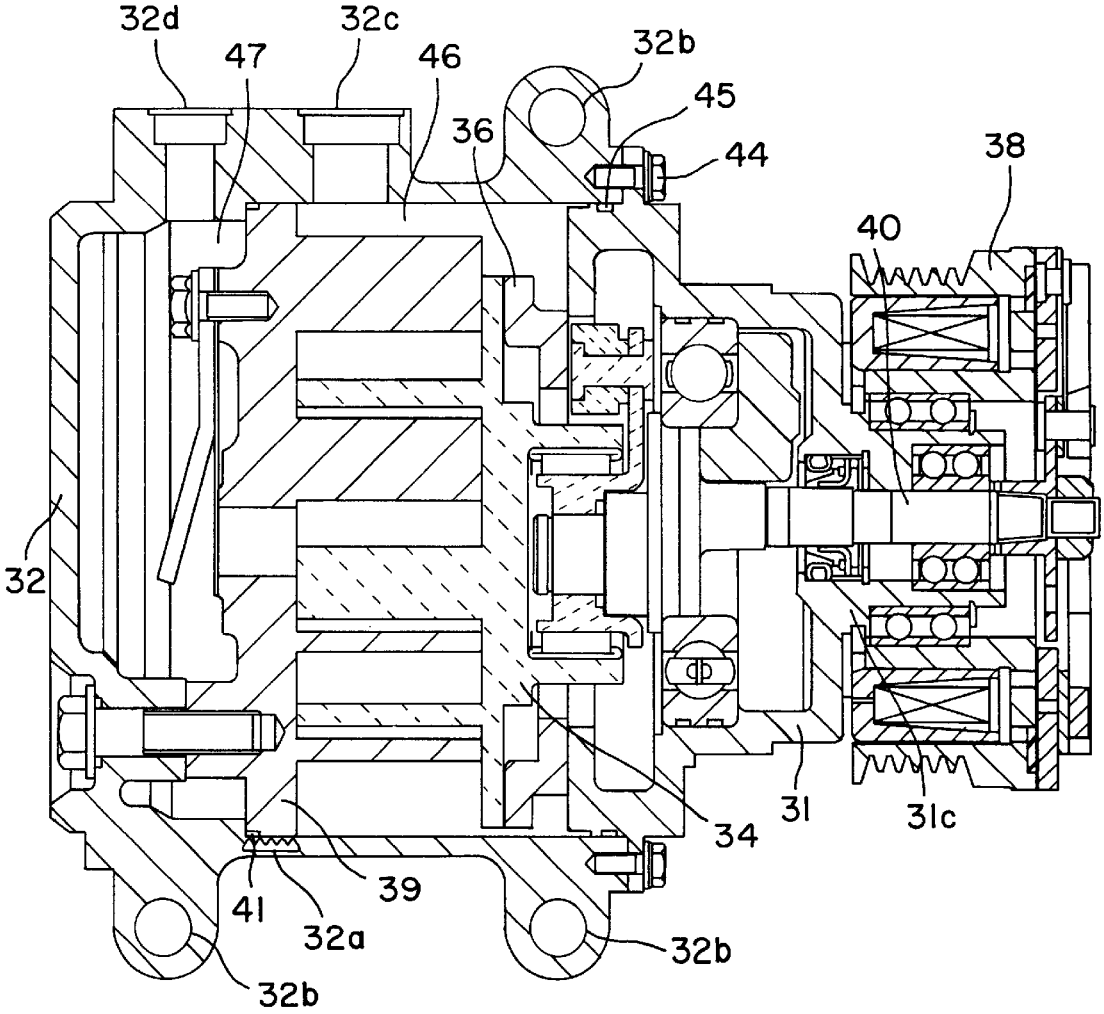
FIG. 6 PRIOR ART
FIG. 6 is a sectional view of a conventional scroll compressor.

As shown in FIG. 5, the seal member 11 is an O-ring having a nearly T-shape section, and this T-shaped O-ring contacts with the fixed scroll 9, rear cover 10, and inner circumference 1*a*.

The compressor thus constituted as shown in FIG. 5 has an excellent sealing characteristic. However, its effect is slightly-smaller than in the constitution in Fig. 4.

The discharge port 16 is formed in the front casing.

Even in this modified example, the same effect as in the embodiment is obtained.

As described herein, according to the constitution of the invention, the pressure in the suction chamber composed of the front casing and fixed scroll, the pressure in the discharge chamber composed of the fixed scroll and rear cover, and the atmospheric pressure can be partitioned by one seal member, so that the scroll compressor can be easily sealed and assembled. Moreover, by using one seal member only, the scroll compressor can be sealed, so that the manufacturing cost is saved.

In particular, excellent effects are obtained in the constitution of forming a nearly triangular recess at the butt junction of the fixed scroll and rear cover.

Further, when the compressor of the invention is installed in the machine, the compressor can be mounted easily at correct position at high precision.

What is claimed is:

1. A sealing method of a scroll compressor, said scroll compressor comprising:

(a) a cylindrical front casing having a bottom, an opening, and an inner circumference, (b) a rear cover fitted to said inner circumference to cover said opening, (c) a fixed scroll having an end plate fitted to said inner circumference, a fitting portion fitted concentrically to said rear cover, and a spiral blade, (d) a movable scroll engaged with said fixed scroll to swivel in a specified radius of swivel, and (e) a rotation preventive mechanism for preventing rotation of said movable scroll to permit swivel motion only, said sealing method comprising:

forming a first chamfering portion at a first outer circumference of said fixed scroll, forming a second chamfering portion at a second outer circumference of said rear cover, forming a recess in a butt junction of said fixed scroll and said rear cover by assembling said first chamfering portion of said fixed scroll and said second chamfering portion of said rear cover, fitting a seal member to said recess, and assembling said fixed scroll and rear cover fitting said seal member into said front casing, thereby creating a seal between a suction pressure and discharge pressure, and a seal between the discharge pressure and atmospheric pressure.

2. A sealing method of claim 1, wherein said recess has a nearly triangular shape.

3. A sealing method of claim 1, wherein said scroll compressor further comprises a shaft coupled to said movable scroll in said front casing and exposed to outside from said bottom, and an electromagnetic clutch coupled to said shaft at said outside.

4. A scroll compressor for compressing a refrigerant comprising:

(a) a front casing having an inner circumference, a bottom and an opening, (b) a fixed scroll disposed in said front casing, (c) a movable scroll disposed between said bottom and said fixed scroll, (d) a rear cover disposed to cover said opening, (e) a suction chamber surrounded by said inner circumference, fixed scroll, and rear cover, (f) a discharge chamber surrounded by said inner circumference, fixed scroll, and rear cover, and (g) a seal member, wherein said fixed scroll has a first fitting portion and a first outer circumference fitted to said inner circumference, said rear cover has a second fitting portion, and a second outer circumference fitted to said inner circumference, said first fitting portion and said second fitting portion form a mutually joined butt junction, said seal member is disposed at said butt junction so as to contact with said first fitting portion, second fitting portion and inner circumference, said seal member seals between said suction chamber and discharge chamber, and between said outside of the rear cover and discharge chamber, wherein said butt junction has a first chamfering portion at said first outer circumference, and has a second chamfering portion at said second outer circumference, a space surrounded by said first chamfering portion, second chamfering portion, and inner circumference forms a recess, said recess has a nearly triangular shape, and said seal member is disposed in said recess.

5. A scroll compressor of claim 4, wherein said fixed scroll has an end plate and a spiral blade, said movable scroll swivels at specified radius of swivel while being engaged with said fixed scroll, and said refrigerant is compressed by said fixed scroll and movable scroll.

6. A scroll compressor of claim 4, further comprising a rotation preventive mechanism for preventing rotation while permitting swivel motion only of said movable scroll.

7. A scroll compressor of claim 4, further comprising a shaft coupled to said movable scroll in said front casing and exposed to outside from said bottom, and an electromagnetic clutch coupled to said shaft at the outside.

8. A scroll compressor for compressing a refrigerant comprising:

(a) a front casing having an inner circumference, a bottom and an opening, (b) a fixed scroll disposed in said front casing, (c) a movable scroll disposed between said bottom and said fixed scroll, (d) a rear cover disposed to cover said opening, (e) a suction chamber surrounded by said inner circumference, fixed scroll, and rear cover, (f) a discharge chamber surrounded by said inner circumference, fixed scroll, and rear cover, and (g) a seal member, and (h) a rotation preventive mechanism for preventing rotation while permitting swivel motion only of said movable scroll, wherein said fixed scroll has a first fitting portion and a first outer circumference fitted to said inner circumference, said rear cover has a second fitting portion, and a second outer circumference fitted to said inner circumference, said first fitting portion and said second fitting portion form a mutually joined butt junction, said seal member is disposed at said butt junction so as to contact with said first fitting portion, second fitting portion and inner circumference, said seal member seals between said suction chamber and discharge chamber, and between said outside of the rear cover and discharge chamber, said first outer circumference has a first chamfering portion, said second outer circumference has a second chamfering portion, said butt junction has a nearly triangular recess surrounded by said first outer circumference, second outer circumference, and inner circumference, said seal member is disposed in said recess, said fixed scroll has an end plate fitted to said inner circumference, said first fitting portion to be fitted concentrically to said rear cover, and a spiral blade disposed at the opposite side of said first fitting portion, said movable scroll is engaged with said fixed scroll, and swivels at a specified radius of swivel, and said refrigerent is compressed by said fixed scroll and movable scroll.

9. The scroll compressor of claim 8, further comprising a shaft coupled to said movable scroll in said front casing and exposed to outside from said bottom, and an electromagnetic clutch coupled to said shaft at the outside.

* * * * *